United States Patent [19]

Haynen

[11] 4,148,095

[45] Apr. 3, 1979

[54] LENS HOLDING MEANS FOR LIGHT FIXTURES

[76] Inventor: Gilbert M. Haynen, 216 Academy Rd., Winnipeg, Canada

[21] Appl. No.: 834,287

[22] Filed: Sep. 19, 1977

[30] Foreign Application Priority Data

Oct. 7, 1976 [CA] Canada ..... 262951

[51] Int. Cl.[2] ..... F21S 3/00; F21S 3/06; F21V 21/00

[52] U.S. Cl. ..... 362/223; 362/370; 362/396

[58] Field of Search ..... 362/217, 223, 260, 396, 362/374, 370

[56] References Cited

U.S. PATENT DOCUMENTS

| | | | |
|---|---|---|---|
| 3,415,018 | 12/1968 | Sutter | 362/223 |
| 3,794,830 | 2/1974 | Hitzler | 362/223 |
| 4,045,665 | 8/1977 | Williams | 362/223 |

*Primary Examiner*—Samuel W. Engle
*Assistant Examiner*—Donald P. Walsh
*Attorney, Agent, or Firm*—Stanley G. Ade

[57] ABSTRACT

A spring clip is secured to a support at each end of a light fixture such as a fluorescent light fixture and the clip extends downwardly therefrom. It is provided with at least one projection which snap engages a bead formed on the upper end edges of a lens component thus detachably securing the lens in position in an easy and unobtrusive manner.

1 Claim, 7 Drawing Figures

LENS HOLDING MEANS FOR LIGHT FIXTURES

BACKGROUND OF THE INVENTION

This invention relates to new and useful improvements in lamp fixtures such as fluorescent lamp fixtures.

With present day decorating trends, it has become desirable to provide means to deatachably secure the lens to the lamp fixture in a way that allows ready access to the lamp fixture for repair and maintenance purposes.

Unfortunately the majority of these method include a form of bale which swings downwardly and engages under each end of the lens or some other method which is at once obvious and detracts from the ascetic appeal of the overall ceiling system.

SUMMARY OF THE INVENTION

The invention overcomes these disadvantages by providing an obtrusive and easily operated means whereby the lens can be detachably secured to the lamp fixture and it is applicable particularly to the present day coffered ceiling system although of course it can be used in other environments.

One aspect of the invention contemplates a ceiling light construction in which a support member is provided upon which the elongated lamp fixture is secured. A lens assembly is detachably engaged upon the lamp fixture and means are provided to detachably secure the lens assembly to the lamp fixture. The means provided comprises at least one lens engaging clip secured by one end thereto to a support member and depending downwardly therefrom adjacent one end of the lamp fixture. Clip engaging means are provided on the upper edge of the lens assembly and resilient means are provided adjacent the lower end of the lens engaging clip which detachably engages with the clip engaging means on the lens assembly in order to detachably secure the lens assembly in an unobtrusive manner yet at the same time permits ready detachment of the lens assembly for repair and maintenance.

Another aspect of the invention contemplates the use of a spring clip adjacent one end of the lamp assembly having a projection which is engaged by a bead or similar means on the lamp assembly with the clip so positioned that upward pressure of the lens assembly into its position upon the lamp fixture, automatically engages the clips with the bead on the upper end of the lens so that the lens is held securely. In order to detach the lens it is merely necessary to move the clip outwardly thus allowing the lens to be withdrawn from the lamp fixture.

The device is simple in operation, economical in manufacture and otherwise well suited to the purpose for which it is designed.

With the foregoing objects in view, and other such objects and advantages as will become apparent to those skilled in the art to which this invention relates as this specification proceeds, my invention consists essentitally in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 2:
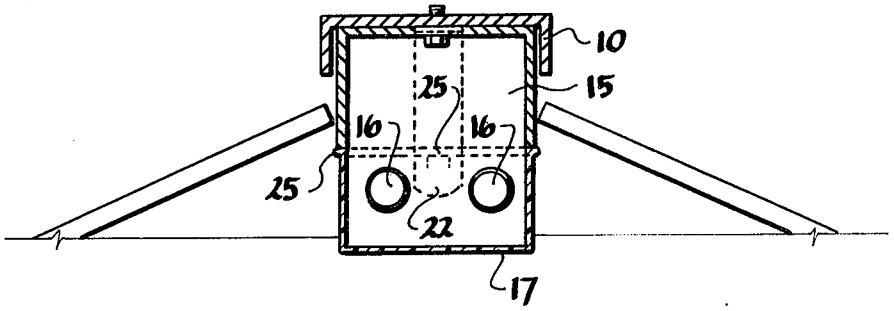
FIG. 2 is a cross sectional view of FIG. 1.
Figure 1:
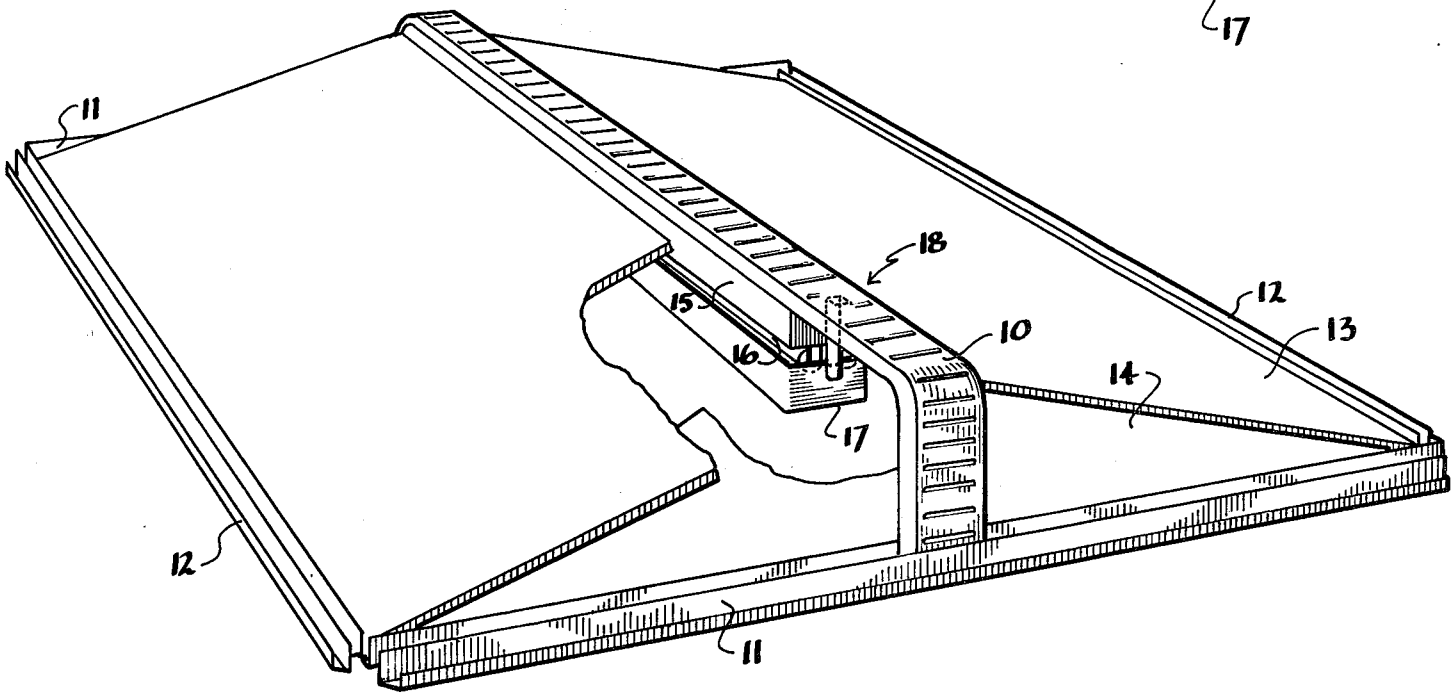
FIG. 1 is an isometric view of one section of a modern cofferd ceiling system showing the invention installed adjacent one end thereof.

Proceeding therefore to describe the invention in detail, reference should first be made to FIG. 1 in which 10 illustrates a generally supporting truss which may be secured to the ceiling in a well known manner.

This truss supports main runners 11 at each end thereof and cross tees 12 extending between the main runners thus providing support for acoustical side panels 13 and acoustical end panels 14 all of which are well known in the art and are conventional.

An elongated lamp fixture 15 is secured to the main part of the truss member 10 and contains one or more fluorescent tubes 16 or similar illuminating means and a lens assembly 17 engages the underside of the lamp fixture 15 and is held in position by a spring clip collectively designated 18 being preferably positioned one at each end of the lamp fixture.

However it will be appreciated that other well known means can be used to support one end of the lens assembly with the spring clip 18 being provided at the other. For example the upper edge of the lens assembly could be provided with projecting portions which merely engage slots in a member adjacent one end of the lamp fixture with the other end of the lens assembly being detachably secured by means of a clip such as that illustrated by reference character 18.

Figure 3:
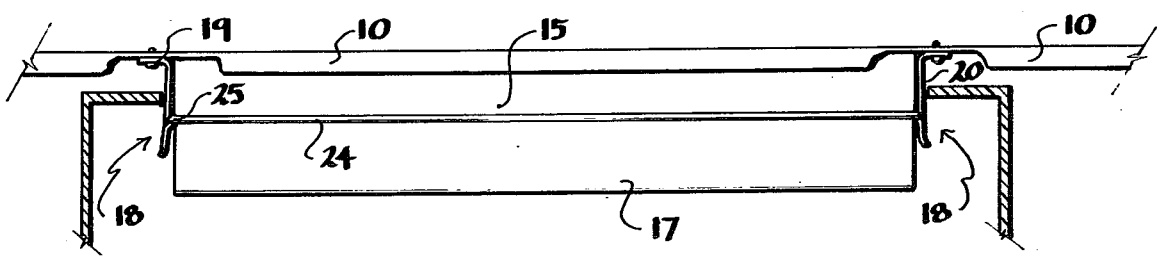
FIG. 3 is a side elevation of a lens assembly held in position by two spring clips one at each end.

FIG. 3 shows a side elevation in which two clip 18 are shown one adjacent each end of the light or lamp fixture 15 and being secured to the overhead support member 10 or any other support member normally utilized to support ceiling lamp fixtures.

Figure 6:
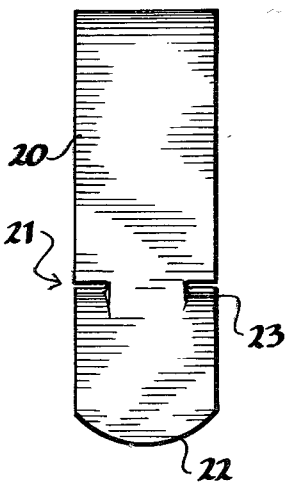
FIG. 6 is a front elevation of FIG. 4.
Figure 5:
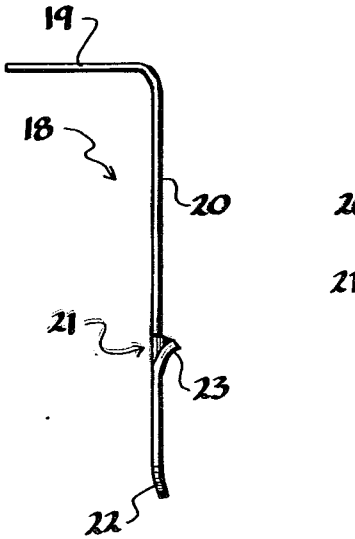
FIG. 5 is a side elevation of FIG. 4.
Figure 4:
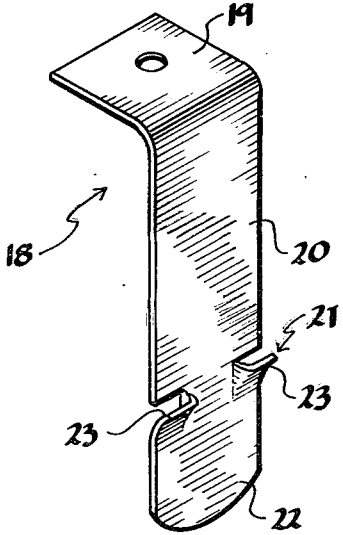
FIG. 4 is an isometric view of one of the spring clips per se.

The clip 18 is shown in detail in FIGS. 4, 5 and 6 and is manufactured preferably from a resilient material such as spring steel. It includes an attaching portion 19 by which it may be secured to the support 10 either by welding, riveting or bolting or any other well known means.

The main portion 20 of the spring clip 18 extends at right angles to the attaching portion 19 as clearly illustrated and is provided with lens engaging means 21 adjacent the lower ends 22 thereof. In this embodiment, the metal forming the main portion 20 is struck outwardly on either edge to provide an extending tang 23, said tangs extending in a direction opposite to the attaching portion 19. However such a projecting portion can be formed centrally of the main portion 20 if desired or only one such tang may be provided. However in the preferred embodiment, tangs are provided struck out from either side edge of the main portion 20.

The lens assembly 17 is normally manufactured from synthetic plastic either clear or opaque and is normally provided with an annular bead 24 on or adjacent the upper edge 25 thereof and this bead is utilized as a clip engaging means when the lens assembly is offered upwardly into position to the lamp fixtures 15.

Figure 7:
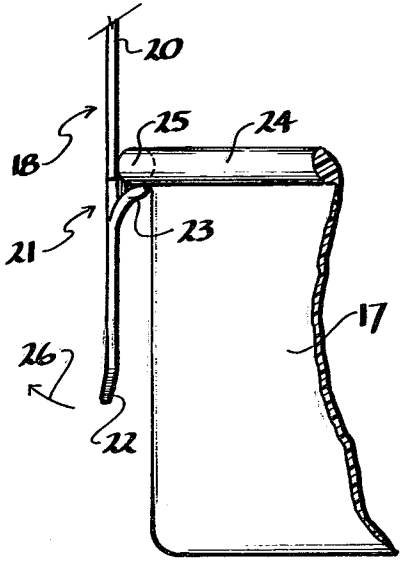
FIG. 7 is an enlarged fragmentary side elevation showing the engagement of the lens with one of the spring clips.

The clips 18 are positioned so that when the lens assembly is pushed upwardly onto the lamp fixture 15, the beads 25 at each end of the fixture, cause the main portions 20 of the clips to move outwardly in direction of arrow 26 so that the beads 25 pass the tangs 23 and rest thereon as clearly shown in FIG. 7 thus securing the lens assembly firmly in position upon the lamp fixture 15.

When it is desired to remove the lens assembly, the small projecting lower ends 22 of the clips are merely moved outwardly in the direction of arrow 26 thus allowing the lens assembly to be removed.

It will therefore be seen that only relatively small downwardly projecting lower ends 22 of the clips are visible once the lens assembly is installed.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A ceiling light construction which includes a support member, an elongated lamp fixture secured to said support member and a lens assembly; means to detachably secure said lens assembly to said lamp fixture, said means comprising at least one lens engaging clip secured by one end thereof to a support member and depending downwardly therefrom, clip engaging means on said lens assembly said clip engaging means on said lens assembly comprises a bead formed adjacent the upper edge of said lens assembly and resilient means adjacent the other end of said lens engaging clip detachably engageable under said bead on said lens assembly, said bead and said means adjacent the other end of said clip co-operating together to detachably secure said lens assembly to said lamp fixture, said means adjacent the other end of said clip comprises at least one projecting portion struck from the material of said clip and extending outwardly therefrom, said projecting portion engaging under said bead, said projecting portion being spaced from said other end whereby said other end consists of a clip moving portion, said other end being angulated outwardly opposite to said projecting portion, said resilient means normally urging said projecting portion into engagement under said bead.

* * * * *